US010195717B2

(12) United States Patent
Francois et al.

(10) Patent No.: US 10,195,717 B2
(45) Date of Patent: Feb. 5, 2019

(54) ABRASIVE TOOL HAVING A PARTICULAR POROSITY VARIATION

(75) Inventors: Emmanuel C. Francois, Sterling, MA (US); Konstantin S. Zuyev, Grafton, MA (US); Muthu Jeevanantham, Worcester, MA (US); Anne M. Bonner, Nashua, NH (US); Michael W. Klett, Holden, MA (US); Dean S. Matsumoto, Worcester, MA (US)

(73) Assignees: SAINT-GOBAIN ABRASIVES, Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 722 days.

(21) Appl. No.: 12/849,678

(22) Filed: Aug. 3, 2010

(65) Prior Publication Data

US 2011/0041413 A1 Feb. 24, 2011

Related U.S. Application Data

(60) Provisional application No. 61/230,942, filed on Aug. 3, 2009.

(51) Int. Cl.

| | |
|---|---|
| ***B24D 3/02*** | (2006.01) |
| ***B24D 3/34*** | (2006.01) |
| ***B24D 5/08*** | (2006.01) |
| ***B24D 7/08*** | (2006.01) |

(52) U.S. Cl.

CPC ..... *B24D 3/02* (2013.01); *B24D 3/342* (2013.01); *B24D 5/08* (2013.01); *B24D 7/08* (2013.01)

(58) Field of Classification Search

USPC ..... 51/307; 451/540

See application file for complete search history.

(56) References Cited

U.S. PATENT DOCUMENTS

| | | | | |
|---|---|---|---|---|
| 1,975,070 | A * | 10/1934 | Benner et al. | 451/544 |
| 2,643,945 | A * | 6/1953 | Buckner | B24D 5/04 451/546 |
| 2,682,735 | A * | 7/1954 | Buckner | B24D 13/14 451/536 |
| 2,770,928 | A * | 11/1956 | Van Ormer | B24D 11/00 451/529 |

(Continued)

FOREIGN PATENT DOCUMENTS

| | | | |
|---|---|---|---|
| CN | 1126964 | A | 7/1996 |
| CN | 2681855 | Y | 3/2005 |

(Continued)

OTHER PUBLICATIONS

U.S. Appl. No. 12/849,674, filed Aug. 3, 2012, Inventors: Emmanuel C. Francois et al.

(Continued)

*Primary Examiner* — Colleen P Dunn
*Assistant Examiner* — Ross J Christie
(74) *Attorney, Agent, or Firm* — Abel Law Group, LLP; Thomas Osborn

(57) ABSTRACT

An abrasive tool can have a body including an abrasive portion with abrasive grains contained within a matrix material. A first reinforcing member can be contained within the body. The body can also include a porosity variation difference through at least half of a thickness of the body of not greater than 250% from a mean porosity of the body.

14 Claims, 4 Drawing Sheets

(56) References Cited

U.S. PATENT DOCUMENTS 2,880,080 A * 3/1959 Rankin et al. ..... 51/297
2,943,926 A * 7/1960 Goepfert ..... B24D 18/00 51/293
3,030,743 A 4/1962 Raymond
3,146,560 A * 9/1964 Hurst ..... 51/293
3,190,045 A * 6/1965 Zuzelo ..... 451/548
3,248,824 A * 5/1966 Zuzelo ..... 451/548
3,252,775 A * 5/1966 Tocci-Guilbert ..... B24D 13/02 264/54
3,273,984 A * 9/1966 Nelson ..... B24D 3/32 51/296
3,315,418 A * 4/1967 Zawodni ..... B24D 5/04 29/419.1
3,400,497 A * 9/1968 Shoemaker ..... 451/548
3,401,491 A * 9/1968 Schnabel et al. ..... 51/295
3,427,759 A 2/1969 Kistler et al.
3,477,180 A * 11/1969 Robertson, Jr. ..... B24D 5/04 51/298
3,730,808 A * 5/1973 Fekete et al. ..... 156/332
3,838,543 A 10/1974 Lakhani
3,867,795 A * 2/1975 Howard ..... C09K 3/1409 451/544
3,868,793 A * 3/1975 Corcoran ..... B24D 18/0009 451/546
3,982,358 A * 9/1976 Fukuda ..... B24D 18/00 451/533
4,007,020 A * 2/1977 Church ..... B24D 3/348 51/295
4,226,602 A 10/1980 Fukuda
4,997,461 A * 3/1991 Markhoff-Matheny ..... C09K 3/1409 51/293
5,037,453 A 8/1991 Narayanan et al.
5,160,509 A * 11/1992 Carman et al. ..... 51/307
5,221,294 A * 6/1993 Carman et al. ..... 51/296
5,582,625 A * 12/1996 Wright ..... B24D 3/28 428/359
5,674,122 A * 10/1997 Krech ..... 51/298
5,690,707 A * 11/1997 Wood ..... C04B 35/01 51/293
5,695,394 A 12/1997 Buffat et al.
5,738,696 A 4/1998 Wu
5,738,697 A * 4/1998 Wu et al. ..... 51/296
5,752,876 A * 5/1998 Hettes ..... 451/463
5,913,994 A * 6/1999 Avril ..... B24D 5/08 156/169
6,086,648 A 7/2000 Rossetti, Jr. et al.
6,440,185 B2 8/2002 Nagata et al.
6,679,758 B2 1/2004 Bright et al.
6,702,650 B2 3/2004 Adefris
6,749,496 B2 6/2004 Mota et al.
6,773,473 B2 * 8/2004 Kinisky ..... B24D 18/00 51/293
7,077,723 B2 7/2006 Bright et al.
7,141,086 B2 * 11/2006 Endoh ..... B24B 7/228 51/307
7,275,980 B2 10/2007 Bonner et al.
7,422,513 B2 9/2008 Bright et al.
7,520,800 B2 * 4/2009 Duescher ..... 451/527
2001/0000838 A1 5/2001 Nagata et al.
2002/0081952 A1 * 6/2002 Fritz et al. ..... 451/56
2003/0084894 A1 5/2003 Sung
2003/0097800 A1 5/2003 Ramanath et al.
2003/0175488 A1 * 9/2003 Asthana et al. ..... 428/212
2003/0194947 A1 * 10/2003 Bright ..... B24B 5/363 451/28
2003/0232586 A1 12/2003 Ramanath et al.
2004/0088926 A1 * 5/2004 Kinisky ..... B24D 18/00 51/296
2004/0235406 A1 * 11/2004 Duescher ..... 51/300
2005/0032469 A1 * 2/2005 Duescher ..... 451/548
2005/0101225 A1 5/2005 Bright et al.
2005/0101237 A1 5/2005 Vecchiarelli et al.
2006/0160476 A1 7/2006 Bright et al.
2006/0205875 A1 * 9/2006 Cha et al. ..... 525/88
2007/0066186 A1 * 3/2007 Annen ..... B24D 11/001 451/41
2007/0151166 A1 * 7/2007 Endres ..... B24D 3/14 51/307
2007/0155293 A1 * 7/2007 Endres ..... C03C 10/00 451/56
2008/0085660 A1 4/2008 Orlhac
2008/0293345 A1 11/2008 Bright et al.
2009/0205259 A1 * 8/2009 Burzynski et al. ..... 51/295
2011/0027564 A1 2/2011 Francois et al.
2011/0041413 A1 2/2011 Francois et al.

FOREIGN PATENT DOCUMENTS

CN 2863361 Y 1/2007
JP 02-053568 A 2/1990
JP H10230457 A 9/1998
JP 2001260034 A 9/2001
JP 2003181762 A 7/2003
JP 2003191170 A 8/2003
WO 2011017356 A2 2/2011
WO 2011017358 A2 2/2011

OTHER PUBLICATIONS

PCT/US2010/044293, International Search Report dated Mar. 2, 2011.
PCT/US2010/044295, International Search Report dated Apr. 1, 2011.

* cited by examiner

ABRASIVE TOOL HAVING A PARTICULAR POROSITY VARIATION

CROSS-REFERENCE TO RELATED APPLICATION(S)

The present application claims priority from U.S. Provisional Patent Application No. 61/230,942, filed Aug. 3, 2009, entitled "Abrasive Tool Having Controlled Porosity Distribution," naming inventors Emmanuel C. Francois, Konstantin S. Zuyev, Muthu Jeevanantham, Anne M. Bonner, Michael W. Klett and Dean Matsumoto, which application is incorporated by reference herein in its entirety.

BACKGROUND

Field of the Disclosure

The following is directed to an abrasive tool, and particularly directed to an abrasive tool having a particular porosity variation.

Description of the Related Art

Abrasive wheels are typically used for cutting, abrading, and shaping of various materials, such as stone, metal, glass, plastics, among other materials. Generally, the abrasive wheels can have various phases of materials including abrasive grains, a bonding agent, and some porosity. Depending upon the intended application, the abrasive wheel can have various designs and configurations. For example, for applications directed to the finishing and cutting of metals, some abrasive wheels are fashioned such that they have a particularly thin profile for efficient cutting.

However, given the application of such wheels, the abrasive articles are subject to fatigue and failure. In fact, the wheels may have a limited time of use of less than a day depending upon the frequency of use. Accordingly, the industry continues to demand abrasive wheels capable of improved performance.

SUMMARY

According to one aspect, an abrasive tool is made of a body including an abrasive portion having abrasive grains contained within a matrix material, and a first reinforcing member contained within the abrasive portion, wherein the body comprises a porosity variation difference through at least half of a thickness of the body of not greater than 250% from a mean porosity of the body.

In another aspect, an abrasive tool includes a body having an abrasive portion including abrasive grains contained within a matrix material, and a first reinforcing member contained within the abrasive portion. The body comprises a porosity variation difference of not greater than 250% based on a mean porosity as measured between a first plane extending along an interface between the first reinforcing member and the abrasive portion and a second plane parallel to and spaced apart from the first plane and extending entirely through the abrasive portion along a non-intersecting path with the first reinforcing member.

According to yet another aspect, an abrasive tool includes a body having an abrasive portion including abrasive grains contained within a matrix material, a first reinforcing member contained within the abrasive portion, and a porosity variation difference throughout the entire thickness of the body of not greater than 250% based on a mean porosity. The body further includes a percent thermal expansion within a range between about 20° C. and about 450° C. of not greater than about 0.7%.

In another aspect, an abrasive tool is made of a body including an abrasive portion having abrasive grains contained within a matrix material, a first reinforcing member contained within the abrasive portion, and a porosity variation difference throughout the entire thickness of the body of not greater than 250% based on a mean porosity. The abrasive tool includes a percent increase G-ratio of at least about 15% over conventional abrasive tools, wherein the percent increase is based on the equation $((G_N-G_C)/G_{NC})\times 100)$ wherein $G_N$ represents the G-ratio of an abrasive tool having the porosity variation difference of not greater than 250% and $G_C$ represents the G-ratio of a conventional abrasive tool.

According to still another aspect, an abrasive tool includes a body having an abrasive portion including abrasive grains contained within a matrix material and a first reinforcing member contained within the abrasive portion. The mean porosity of the body is within a range between about 5 vol % and about 30 vol % and the interfacial porosity in a plane extending along an interface between the first reinforcing member and the abrasive portion is not greater than about 30 vol %.

According to one aspect, an abrasive tool includes a body having an abrasive portion including abrasive grains comprising alumina contained within a matrix material comprising an organic material, a first reinforcing member contained within the abrasive portion, and a second reinforcing member contained within the abrasive portion. The body further includes a porosity variation difference of not greater than about 100% based on a mean porosity and measured between a first plane extending along a first interface between the first reinforcing member and the abrasive portion and a second plane extending along a second interface between the second reinforcing member and the abrasive portion.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

The following is directed to abrasive tools utilizing abrasive portions of abrasive grains contained within a matrix material for cutting, abrading, and finishing of workpieces. Certain embodiments herein are directed to large-diameter abrasive wheels incorporating one or more reinforcing members within the body of the tool that are particularly suited for cutting and/or shaping metal.

Figure 1:
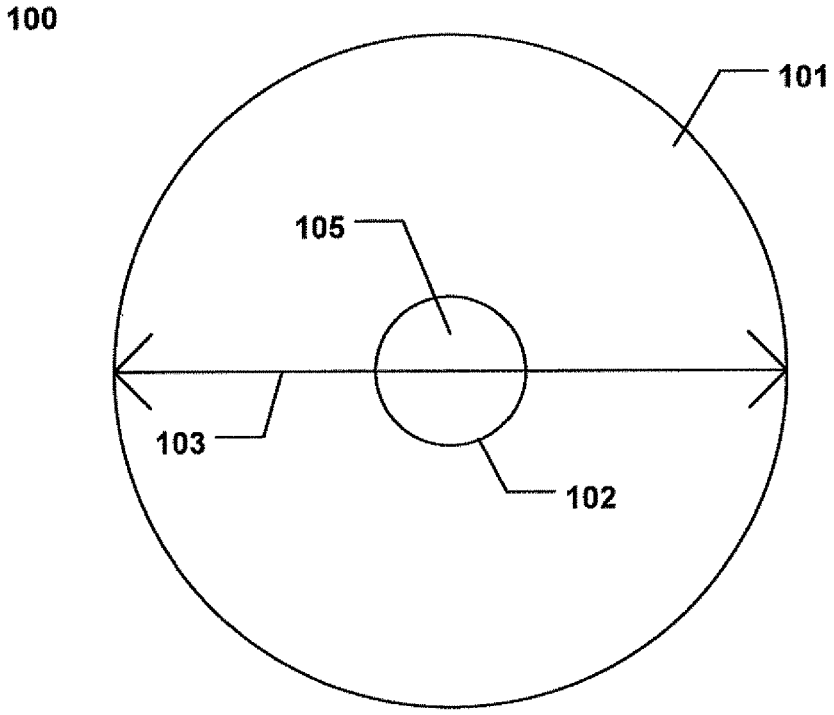
FIG. 1 includes an illustration of an abrasive tool in accordance with an embodiment.

FIG. 1 includes an illustration of an abrasive tool in accordance with an embodiment. Notably, the abrasive tool 100 includes a body 101 having a generally circular shape as viewed in two dimensions. It will be appreciated, that in three-dimensions the tool has a certain thickness such that the body 101 has a disk-like or a cylindrical shape. As illustrated, the body can have an outer diameter 103 extending through the center of the tool, which can be particularly large, having a dimension of at least about 45 cm. In other applications, the body 101 can have an outer diameter 103, such as on the order of at least about 60 centimeters, at least about 75 centimeters, or even at least 100 centimeters. Particular abrasive tools utilize a body 101 having an outer diameter 103 within a range between 45 centimeters and about 200 centimeters, such as between 45 cm and about 175 cm, and more particularly between about 45 centimeters and about 150 centimeters.

As further illustrated, the abrasive tool 100 can include a central opening 105 defined by an inner circular surface 102 about the center of the body 101. The central opening 105 can extend through the entire thickness of the body 101 such that the abrasive tool 100 can be mounted on a spindle or other machine for rotation of the abrasive tool 100 during operation.

Figure 2:
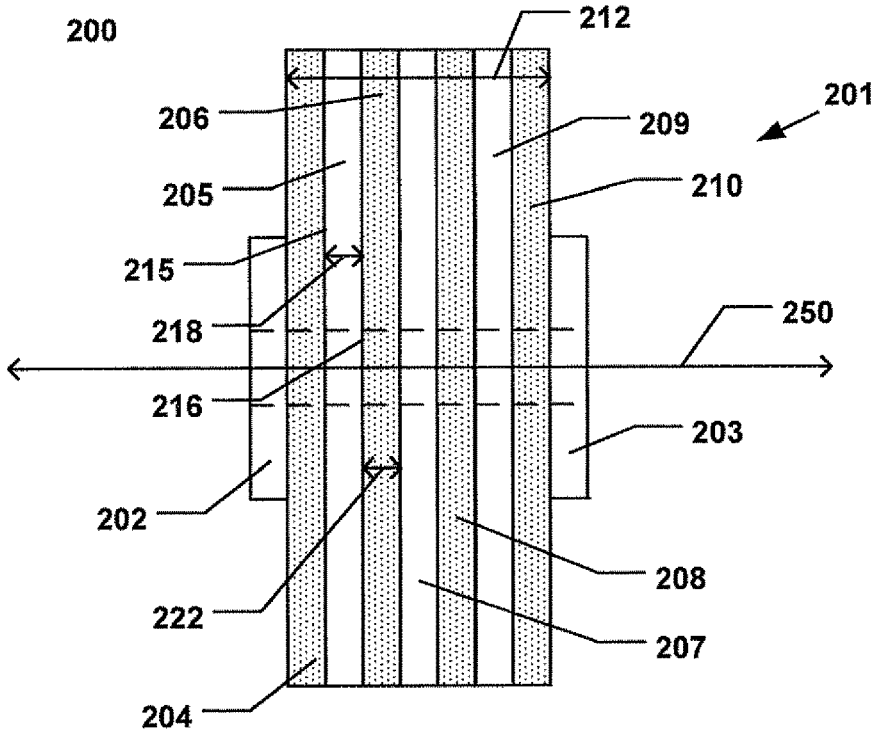
FIG. 2 includes a cross-sectional illustration of a portion of an abrasive tool in accordance with an embodiment.

FIG. 2 includes a cross-sectional illustration of a portion of an abrasive tool in accordance with an embodiment. The abrasive body 201 can be a composite article including a combination of portions of different types of material. In particular, the body 201 can include abrasive portions 204, 206, 208, and 210 and reinforcing members 205, 207, and 209. The abrasive tool 200 can be designed such that the reinforcing members 205, 207, and 209 can be placed within the body such that they are spaced apart from each other, and therein, separate each of the abrasive portions 204, 206, 208, and 210 from each other. That is, the abrasive tool 200 can be formed such that the reinforcing members 205, 207, and 209 are spaced apart from each other laterally through the thickness 212 of the body 201 and separated by abrasive portions 206 and 208. As will be appreciated, in such a design the abrasive portions 206 and 208 can be disposed between the reinforcing members 205, 207, and 209.

As further illustrated, the reinforcing members 205, 207, and 209 can be substantially planar members having first planar faces and second planar faces. For example, the reinforcing member 205 can be formed such that it is a planar member having a first major surface 215 and a second major surface 216. Moreover, the body 201 can have a design such that the abrasive portions 204, 206, 208, and 210 can overlie the major surface of the reinforcing members 205, 207, and 209. For example, the abrasive portion 204 can overlie the first major surface 215 of the reinforcing member 205 and the abrasive portion 206 overlies the second major surface 216 of the reinforcing member 205. In particular instances, the body 201 can be formed such that the abrasive portions 204 and 206 cover essentially the entire surface area of the first major surface 215 and second major surface 216, respectively. Accordingly, the abrasive portions 204 and 206 can directly contact (i.e. abut) the reinforcing member 205 on either sides at the first and second major surfaces 215 and 216.

Notably, the abrasive body 201 can be designed such that the reinforcing members 205, 207, and 209 can extend through a majority of the diameter 103 of the body 201. In particular instances, the reinforcing members 205, 207, and 209 can be formed such that they extend through at least about 75%, such as at least about 80%, or even the entire diameter 103 of the body 201.

In accordance with an embodiment, the body 201 is formed such that it can have an average thickness 212 measured in a direction parallel to the axial axis 250 extending through the center of the central opening 105. The average thickness 212 of the body 201 can be particularly thin such that it is suitable for cutting metal workpieces. For example, the average thickness of the body 201 can be not greater than about 3 centimeters. In other embodiments, the average thickness 212 of the body 201 can be not greater than about 2.5 centimeters, such as not greater than about 2 centimeters, or even not greater than about 1.5 centimeters. Still, certain embodiments may utilize an average thickness 212 within a range between about 0.5 centimeters and about 3 centimeters, such as between about 0.5 centimeters and about 2 centimeters.

The abrasive articles of the embodiments herein can have a particular aspect ratio defined as the ratio between the outer diameter 103 to the average thickness 212 of the body 201. According to certain designs, the aspect ratio is at least about 10:1, such as at least about 20:1, at least about 50:1, or even at least about 75:1. Certain embodiments utilize an aspect ratio within a range between about 10:1 and about 125:1, such as between about 20:1 and about 125:1.

In further reference to the reinforcing members 205, 207, and 209, such members can be made of an organic material, inorganic material, and a combination thereof. For example, the reinforcing members 205, 207, and 209 can be made of an inorganic material, such as a ceramic, a glass, quartz, or a combination thereof. Particularly suitable materials for use as the reinforcing members 205, 207, and 209 can include glass materials, incorporating fibers of glass materials, which may include oxide-based glass materials.

Some suitable organic materials for use in the reinforcing members 205, 207, and 209 can include phenolic resins, polyimides, polyamides, polyesters, aramids, and a combination thereof. For example, in one particular embodiment, the reinforcing members 205, 207, and 209 can include Kevlar™, a particular type of aramid.

Additionally, the reinforcing members 205, 207, and 209 can include a fibrous material having a coating overlying and bonded directly to the external surfaces of the fibers. The coating can be an organic material, inorganic material, or a combination thereof. Certain abrasive tools can use reinforcing members 205, 207, and 209 utilizing fibers having a coating of an organic material, which may be a natural organic material or a synthetic organic material, such as a polymer, which may aid bonding between the reinforcing member and the abrasive portion. Some suitable organic coating materials can include resins, which may be thermosets, thermoplastics, or a combination thereof. Particularly suitable resins can include phenolics, epoxies, polyesters, cyanate esters, shellacs, polyurethanes, and a combination thereof. In one particular instance, the abrasive tool incorporates a reinforcing member comprising phenolic resin-coated glass fibers.

The reinforcing members 205, 207, and 209 can include a plurality of fibers that are woven together. The fibers can be woven or stitched together in a variety of manners. In certain instances, the reinforcing members can be woven together such that a patterns is formed, including fibers extending primarily in two perpendicular directions.

The reinforcing members 205, 207, and 209 can have an average thickness 218 that is defined as the distance between the first major surface 215 and the second major surface 216 of the reinforcing member 205. The average thickness 218 can be less than 0.6 centimeters, such as less than 0.4 centimeters, or even less than 0.25 centimeters.

In relative percentages, depending upon the design of the abrasive article, the reinforcing members can be formed to have certain dimensions such that they compose a certain percentage of the total average thickness of the body. For example, the reinforcing member 205 can have an average thickness 218 that is at least about 3% of the total average thickness 212 of the body 201. In other instances, the reinforcing member 205 can have an average thickness 218 that is at least about 5%, such as at least about 8%, or even at least about 10% of the total average thickness 212 of the body 201. Certain reinforcing members can have an average thickness 218 that is within a range between about 3% and about 15% of the total average thickness 212 of the body 201.

In accordance with embodiments herein, the abrasive tool 200 is formed such that the body 201 includes abrasive portions 204, 206, 208, and 210. Reference will be made in the following paragraphs to the abrasive portion 204, however it will be appreciated that all of the identified abrasive portions can include the same features.

The abrasive portion 204 can be a composite material having abrasive grains contained within a matrix material and further comprising a particular composition and type of porosity. The abrasive grains can include a particularly hard material suitable for abrading and material removal applications. For example, the abrasive grains can have a Vickers hardness of at least about 5 GPa. The hardness of the abrasive grains can be greater in some tools, such that the abrasive grains have a Vickers hardness of at least about 10 GPa, at least about 20 GPa, at least about 30 GPa, or even at least about 50 GPa.

The abrasive grains can include an inorganic material. Some suitable inorganic materials can include oxides, carbides, borides, nitrides, and a combination thereof. For example, the abrasive portion 204 can be formed to include abrasive grains consisting essentially of oxides. Particularly suitable oxides can include alumina, zirconia, silica, and a combination thereof. Some designs can utilize abrasive grains that consist essentially of alumina. Other designs may utilize abrasive grains that incorporate a combination of alumina and/or alumina-zirconia alloys, however in such formulations a greater percentage of abrasive grains may be formed of alumina material than the alumina-zirconia alloy material.

Furthermore, certain abrasive tools may utilize a superabrasive material as the abrasive grains. Superabrasive materials can include diamond, cubic boron nitride, and a combination thereof. In one certain embodiment, the abrasive grains consist essentially of diamond.

The abrasive portions 204, 206, 208, and 210 can be formed such that the abrasive grains are contained within and surrounded by a matrix material to secure the abrasive grains in place for cutting and grinding operations. Generally, the abrasive portions 204, 206, 208, and 210 can be formed such that at least about 40 vol % of the total volume of the abrasive portion includes abrasive grains. In other embodiments, the abrasive grain content within the abrasive portion can be higher, such as on the order of at least about 44 vol %, such as at least about 50 vol %, or even at least about 54 vol % of the total volume of the abrasive portion. Particular embodiments utilize an abrasive portion having between about 40 vol % and 60 vol %, more particularly between about 40 vol % and about 54 vol % abrasive grains. In fact, in one instance, the abrasive portion is made of between about 42 vol % and about 50 vol % abrasive grains of the total volume of the respective abrasive portion.

Generally, the abrasive portion 204 is formed such that at least about 30 vol % of the total volume percent of the abrasive portion is matrix material. In other embodiments, the abrasive portion 204 comprises a greater content of matrix material, such as on the order of at least about 40 vol %, at least about 42 vol %, at least about 44 vol %, or even at least about 46 vol %. Still, embodiments herein may utilize an amount of matrix material within a range between about 30 vol % and about 56 vol %, such as on the order of between about 30 vol % and about 50 vol %, or between about 40 vol % and about 48 vol %.

Embodiments herein can utilize a matrix material that can include an organic material that may function as the primary bonding component. Such organic materials may include natural organic materials, synthetic organic materials, and a combination thereof. In particular instances, the organic material can be made of a resin, which may include thermosets, thermoplastics, and a combination thereof. For example, some suitable resins can include phenolics, epoxies, polyesters, cyanate esters, shellacs, polyurethanes, rubber, and a combination thereof.

In particular instances, the matrix material can be formed such that it comprises a majority amount of the organic material. For example, at least about 65 vol % of the total volume of matrix material can be formed of organic bond material. In other abrasive portions, the content of organic material within the matrix material may be greater, such as at least about 70 vol %, or even at least about 75 vol %. Still, certain embodiments utilize a matrix material having an organic bond material content within a range between about 60 vol % and about 85 vol %, such as between about 65 vol % and about 80 vol %.

The abrasive portions herein may also include filler materials incorporated within the abrasive portion. Certain filler materials may be incorporated as chemically reactive agents intended to react with the surface being shaped. Other filler materials may include moisture absorbers, binders, and various other materials that facilitate the forming process. In accordance with one embodiment, the filler material can be a pore-forming material, such as microspheres that facilitate the formation of certain types of porosity within the final-formed abrasive article.

As further illustrated in FIG. 2, the body can be formed such that it incorporates reinforcing members 202 and 203 that abut the outer surfaces of the abrasive portions 204 and 210 about the central opening 105. In certain designs, the reinforcing members 202 and 203 can extend for a portion of the outer diameter 103, such as half the outer diameter 103 of the abrasive body 201. Provision of the reinforcing members 202 and 203 about the central opening 105 facilitates reinforcement of the body 201 at a location where the abrasive tool 200 is intended to be affixed to a spindle or machine. As will be appreciated, the reinforcing members 202 and 203 can have the same features as the reinforcing members 205, 207, and 209.

Figure 3:
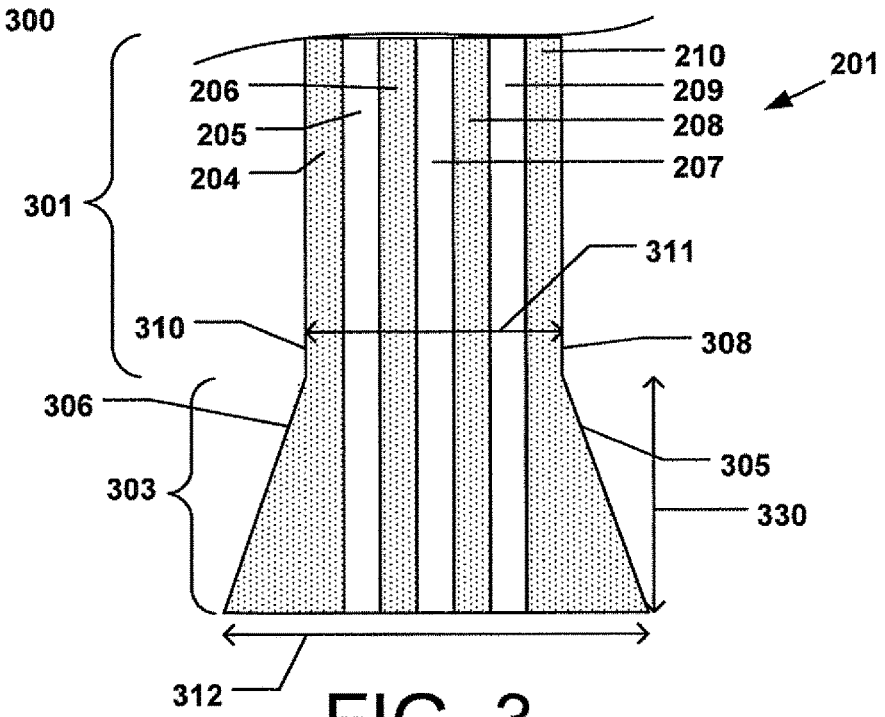
FIG. 3 includes a cross-sectional illustration of a portion of an abrasive tool in accordance with an embodiment.

FIG. 3 includes a cross-sectional illustration of a portion of an abrasive tool in accordance with an embodiment. The portion illustrated includes a portion of the outer circumference of a body 201 including abrasive portions 204, 206, 208, and 210 previously described and illustrated in FIG. 2. Moreover, the abrasive body 201 includes reinforcing members 205, 207, and 209 disposed between the abrasive portions 204, 206, 208, and 210 as previously described and illustrated in FIG. 2.

Notably, the body 201 is formed such that it has a flat region 301 proximate to the center of the wheel and surrounding the central opening 105, and a tapered region 303 at the outer edge of the body 201. As illustrated, the tapered region 303 is formed such that it has an average thickness 312 measured at the outer diameter of the body 201 that is significantly greater than the average thickness 311 of the body 201 within the flat region 301. The formation of the tapered region 303 is facilitated by the extension of a tapered edge 305 of the abrasive portion 210 that extends at an angle to the external surface 308 of the flat region 301 of the abrasive portion 210. The tapered region 303 is further defined by a tapered surface 306 of the abrasive portion 204, which extends at an angle to the surfaces 310 of the abrasive portion 204. As illustrated, the tapered region 303 can form a rim around the outer diameter of the wheel, wherein the tapered surfaces 305 and 306 extend at an angle axially outward from the surfaces 308 and 310, respectively. The tapered surfaces 305 and 306 can extend at an angle to a radius extending from the center of the body substantially parallel to the surfaces 308 and 310, and moreover, the tapered surfaces 305 and 306 can extend at an angle to an axial axis 250 extending through the center of the body 201.

According to some embodiments, the tapered region 303 can extend circumferentially around a portion of a periphery of the body 201. Certain designs may utilize a tapered region 303 that extends throughout the entire circumference of the body 201. While reference is made herein to abrasive articles incorporating a tapered region 303, it will be appreciated, that a tapered region 303 may not necessarily be present for certain abrasive articles.

As illustrated, the tapered region 303 can extend radially from the flat region 301 of the body 201. Embodiments herein may form a tapered region 303 having a length 330, as measured in a direction parallel to a radius extending from the center of the body 201, which can be a particular percentage of the dimension of the outer diameter 103 of the body 201. For example, the tapered region 303 can have a length 330 that is at least about 5% of the dimension of the outer diameter 103. In other cases, depending upon the intended application, the body 201 can have a tapered region 303 having a length 330 of at least about 10%, such as at least about 15%, at least about 20%, at least about 30%, or even at least about 35%, of the dimension of the outer diameter 103. Particular embodiments can utilize a tapered region 303 wherein the length 330 is within a range between about 5% and about 50%, and particularly between about 5% and about 35%, or even more particularly between about 5% and about 20% of the outer diameter 103.

The length 330 of the tapered region 303 can be at least about 10 centimeters. In some embodiments, the length 330 of the tapered region 303 can be greater, such as at least about 13 centimeters, at least about 15 centimeters, or even at least about 20 centimeters. Still, particular embodiments herein can utilize a tapered region 303 having a length 330 within a range between about 10 centimeters and about 30 centimeters, such as between about 10 centimeters and about 20 centimeters.

As referenced herein, the abrasive portions can be multiphase materials utilizing abrasive grains contained within the matrix material, and further comprising a degree of porosity. Generally, each of the abrasive portions 204, 206, 208, and 210 can be formed to have a certain type of porosity. The porosity can be formed through various techniques including processing for the formation of natural porosity, the use of pore forming materials, of a combination thereof. Pore-forming materials can include organic and/or inorganic materials. For example, beads or microspheres of a certain material, such as a polymer material, a glass material, or a ceramic material can be incorporated in the initial mixture, and a portion of which can be volatilized during processing to leave a pore within the final-formed abrasive article. Natural porosity may be the result of generating gases during processing leading to the formation of porosity.

The abrasive portions 204, 206, 208, and 210 can have a mean porosity that is an average total porosity for the total volume of any given abrasive portion. Generally, any of the abrasive portions 204, 206, 208, and 210 can have an average porosity of at least 0.5 vol % of the total volume of the corresponding abrasive portion. In other instances, the average porosity within an abrasive portion can be greater, such as at least about 1 vol %, such as at least about 5 vol %, at least about 8 vol %, at least about 10 vol %, at least about 12 vol %, at least about 15 vol %, or even at least about 20 vol % for the total volume of the abrasive portion. Particular embodiments utilize abrasive portions having a percent porosity within a range between about 0.5 vol % and 30 vol %, such as between about 5 vol % and about 30 vol %, and particularly between about 8 vol % and 26 vol %.

Generally, abrasive articles having a composite structure may demonstrate a variation in the volume percent of the porosity depending upon the location within the body. For example, the porosity within an abrasive portion may vary in a manner, wherein the volume percent porosity at a region within a certain proximity to the interface of the abrasive portion and an abutting reinforcing member may be greater than the volume percent porosity within a region closer to the center of the abrasive portions.

Figure 4:
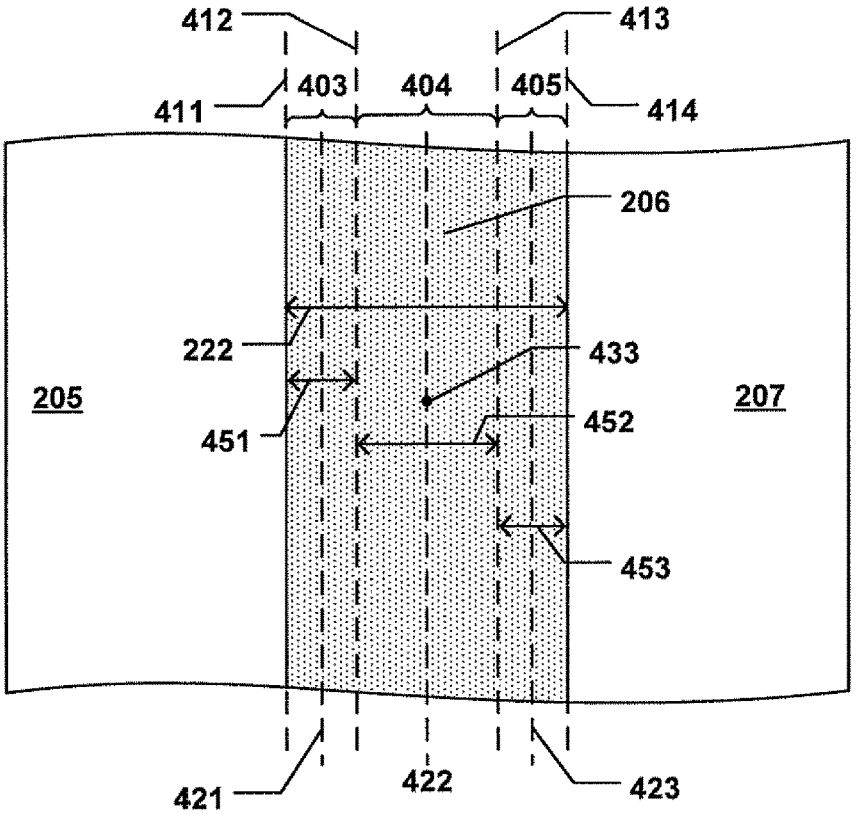
FIG. 4 includes a cross-sectional illustration of a portion of an abrasive tool in accordance with an embodiment.

The abrasive articles according to embodiments here can demonstrate a particular porosity variation. FIG. 4 includes a cross-sectional illustration of a portion of a body 401 of an abrasive article illustrated in FIG. 2 according to an embodiment. As provided, the abrasive portion 206 can be disposed between and abutting the reinforcing members 205 and 207. The abrasive portion 206 includes regions 403, 404, and 405 extending in a radial direction, generally parallel to each other in planes normal to the thickness 222 of the abrasive portion 206. The body 201 can include an interfacial region 403 defining a portion of the abrasive portion 206 between a plane 411 extending along the interface of the abrasive portion 206 and the reinforcing member 205 and a plane 412 extending through the interior of the abrasive portion 206, closer to the center of the abrasive portion 206 than the plane 411. The body can further include an interfacial region 405 defining a portion of the abrasive portion 206 between a plane 414 extending along the interface of the abrasive portion 206 and the reinforcing member 207 and a plane 413 extending through the interior of the abrasive portion 206, closer to the center of the abrasive portion 206 than the plane 414. The body can further include a central region 404 disposed between the interfacial regions 403 and 404 that include a central point 433 at a midpoint of the dimension of the thickness 222 of the abrasive portion 206. The central region 404 defines a portion of the abrasive portion 206 between a plane 412 and a plane 413 extending through an interior of the abrasive portion 206.

The regions 403-405 are used herein to identify areas with the abrasive portion 206 that can have different characteristics. The regions 403-405 can each have a width, such that interfacial region 403 has a width 451, the central region 404 has a width 452, and interfacial region 405 has a width 453. It will be appreciated that the central region 404 can have a width 452 that is greater than the widths 451 and 453 of the interfacial regions 403 and 405, respectively.

The following will reference the abrasive portion 206 as an exemplary abrasive portion, and it will be appreciated that any of the abrasive portions 204, 206, 208, or 210 can have the features discussed. Generally, the abrasive portion 206 can have an interfacial porosity that can be measured along a plane within the interfacial regions 403 and/or 405 abutting the interfaces between the abrasive region 206 and the reinforcing members 205 and 207. More particularly, the interfacial porosity can be measured at the interfaces between the reinforcing members 205 and 207 and the abrasive portion 206. Abrasive portions according to embodiments herein can have an interfacial porosity not greater than about 30 vol % of the total volume of the abrasive portion 206. In other instances, the interfacial porosity is less, such as not greater than about 28 vol %, not greater than about 25 vol %, or even not greater than about 23 vol %. Particular embodiments utilize abrasive portions having an interfacial porosity within a range between about 10 vol % and about 30 vol %, such as between about 15 vol % and about 30 vol %, or even between about 18 vol % and about 30 vol %.

Notably, in particular instances, the volume percent of interfacial porosity of the abrasive portion 206 as measured within a plane within the interfacial regions 403 and/or 405 can be greater than mean porosity of the abrasive portion 206. The volume percent porosity measured within a plane within the interfacial regions 403 or 405, such as planes 421 or 423, may in some instances, be greater than a volume of porosity within a plane extending through the central region 404, such as plane 422, of the abrasive portion 206.

The abrasive tools herein can have a particularly homogeneous porosity and uniform dispersion of porosity throughout the thickness of the body as compared to conventional tools. According to one embodiment, the body can be formed such that it has a porosity variation throughout the body based on a mean porosity, which can be calculated based on the equation: $P_{variation}=((P_M/P_a)-1)\times 100\%$, wherein $P_M$ is the measured porosity in a given plane, and $P_a$ is the calculated or measured average (or mean) porosity of the body or abrasive portion, depending upon the area being characterized. The porosity variation indicates the differences in the amount of porosity at different locations as compared to a mean porosity of an abrasive portion or the entire tool body, and therefore the porosity variation can indicate the uniformity of porosity dispersion throughout one abrasive portion or the entire tool body, depending upon the area characterized.

Figure 5:
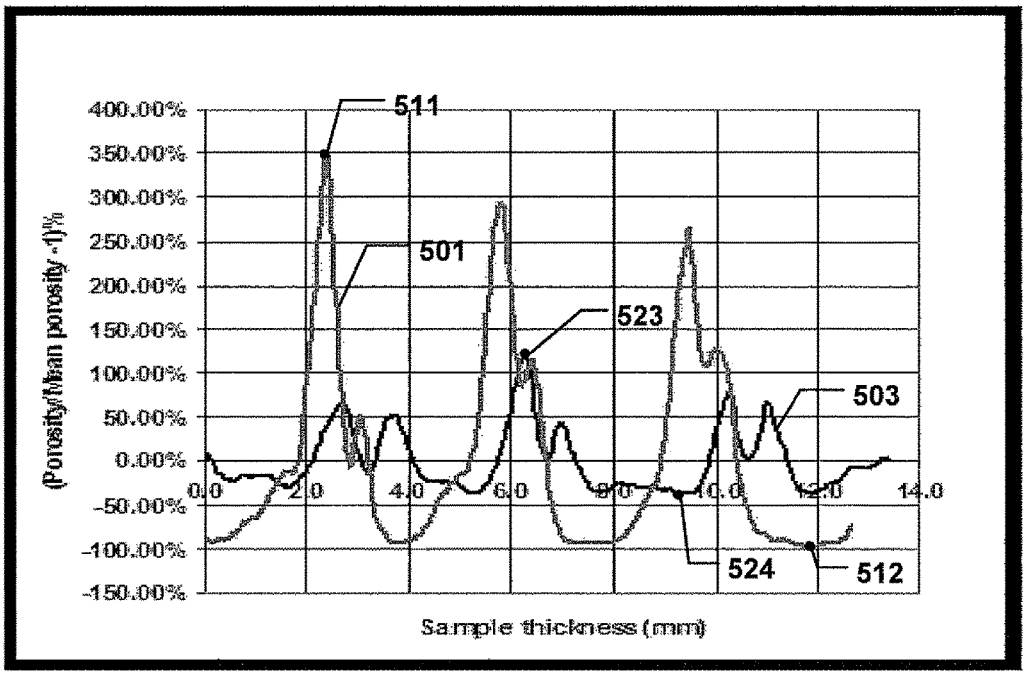
FIG. 5 includes a plot of the porosity variation of a conventional tool and an abrasive tool in accordance with an embodiment.

Measurement of the porosity variation is based on use of imaging technology, including x-ray scanning technologies, allowing measurement and non-destructive characterization of particular locations and discrete planes extending through the abrasive tools. Such measurements can be used to generate porosity variation curves of porosity variation based on a mean as a function of position, such as a location along the dimension of the thickness of the abrasive tool, as illustrated in FIG. 5.

In particular instances, a porosity variation can be calculated between two particular planes within an abrasive portion. For example, the porosity of a portion of the tool can be measured within a first plane, such as the plane 421 extending within the interfacial region 403 of the abrasive portion 206, which can be compared to the mean porosity of the abrasive portion 206 (or the tool body) to generate a porosity variation represented by the value $PV_1$. Moreover, the porosity can be measured within a second, different plane, such as the plane 422 within the central region 404, wherein the plane 422 is parallel to and spaced apart from the plane 421 and extends entirely through the abrasive portion 206 along a non-intersecting path with adjacent reinforcing members 205 and 207. The measure porosity within the second plane 422 can be used to calculate the porosity variation based on the mean porosity of the abrasive portion 206 (or tool body), which can be represented by a value of $PV_2$.

More particularly, the abrasive tools can have a particularly homogenous and/or uniform dispersion of porosity characterized by a porosity variation difference. The porosity variation difference can be calculated by comparing the porosity variation values for two particular planes within an abrasive portion. The planes are selected such that one plane represents a region of the greatest positive porosity variation from the mean (typically represented as a positive percentage), and the other plane is representative of a region of the greatest negative porosity variation based on the mean porosity (typically represented as a negative percentage). As such, the porosity variation difference between $PV_1$ and $PV_2$ can be completed based on the equation $(PV_1-PV_2)$, wherein $PV_1 \geq PV_2$. In certain embodiments, the porosity variation difference between two planes within an abrasive portion can be not greater than about 250%. In other embodiments, the porosity variation difference can be less, such as not greater than about 225%, not greater than about 200%, not greater than about 175%, not greater than about 150%, not greater than about 125%, not greater than about 100%, not greater than about 75%, not greater than about 50%, or even not greater than about 25%. Particular embodiments utilize an abrasive portion 206 having a porosity variation difference between the planes 421 and 422 within a range between about 20% and about 250%, such as between about 20% and about 225%, and more particularly on the order of between about 20% and about 200%, or even between about 20% and about 175%.

Embodiments herein can also demonstrate a particular uniformity in the dispersion of the porosity between interfacial regions 403 and 405 of an abrasive portion. For instance, the porosity variation difference between the porosity measured in a plane within the interfacial region 403 (e.g., plane 421) as compared to the porosity measured in a plane within the interfacial region 405 (e.g., plane 423) can be not greater than about 100%. In more particular embodiments, the porosity variation difference between interfacial regions of an abrasive portion can be not greater than about 90%, not greater than about 80%, not greater than about 75%, not greater than about 60%, not greater than about 50%, not greater than about 40%, not greater than about 30%, or even not greater than about 25%. Particular embodiments utilize an abrasive portion 206 having a porosity variation difference measured between the planes 421 and 423 within a range between about 1% and about 100%, such as between about 1% and about 75%, and more particularly on the order of between about 3% and about 25%, or even between about 3% and about 15%.

Furthermore, the body can have a porosity variation difference as measured between two locations within the tool body, that demonstrates particularly uniform porosity dispersion. Notably, unlike the measurements of porosity variation for only the abrasive portion, the measurements of porosity variation for the entire body are based upon the mean porosity of the entire body of the abrasive tool.

The porosity variation difference for the tool body, which includes the abrasive portions 204, 206, 208, and 210 and the reinforcing members 205, 207, and 209, can be not greater than about 250% based upon measurements taken through at least half of the total thickness 212 of the tool body 201. In other instances, the porosity variation difference for the tool body 201 can be not greater than about 225%, not greater than about 200%, not greater than about 175%, not greater than about 150%, not greater than about 125%, not greater than about 100%, not greater than about 75%, not greater than about 50%, or even not greater than about 25%. Particular embodiments can utilize a tool body 201 having a porosity variation difference as measured through at least half of the total thickness 212 within a range between about 20% and about 250%, such as between about 20% and about 225%, and more particularly on the order of between about 20% and about 200%, or even between about 20% and about 175%.

While the foregoing has made reference to values in the difference of porosity variation through at least half of the total thickness 212 of the tool body 201, it will be appreciated that such features are for a suitable sampling of the tool body. Generally, to assure proper sampling and accuracy of the porosity within the tool body, the measurements and calculations can be conducted in a manner wherein the first plane of measurement and the second plane of measurement are spaced apart from each other laterally by a distance of at least about 10% of a total thickness 212 of the body 201. Still, the porosity variation difference values can be the same for a sampling of at least 75% of the total thickness 212 of the tool body 201 and even for measurements taken through essentially the entirety of the total thickness 212 of the tool body 201.

The abrasive tools described herein can have certain features that make the abrasive tool suitable for improved grinding and/or cutting applications. Notably, the percent thermal expansion of the abrasive tools can be minimized. For example, the abrasive articles of embodiments herein demonstrate an improved percent thermal expansion as compared to conventional abrasive articles over a range of 25° C. to 450° C. Notably, for comparative purposes, the conventional abrasive articles included abrasives of the same design having the abrasive portion and reinforcing members. According to empirical evidence, the abrasive tools of the embodiments herein demonstrated a percent decrease in the percent thermal expansion of at least about 5% over conventional abrasive tools. The percent decrease is based on the equation $((TE_C-TE_N)/TE_C)\times100\%)$, wherein $TE_N$ represents the thermal expansion of an abrasive tool according to embodiments herein and $TE_C$ represents the thermal expansion of a conventional abrasive tool. In other embodiments, the percent decrease of percent thermal expansion is at least about 10%, such as at least about 20%, at least about 50%, at least about 75%, or even at least about 100%. Particular embodiments demonstrate a percent thermal expansion within a range between about 5% and about 150%, and more particularly between about 5% and about 100%, and even more particularly between about 5% and about 75%. Such distinctions were demonstrated using standard thermo-mechanical analysis (TMA).

In more particular terms, the abrasive articles of embodiments herein can have a percent thermal expansion over a range of 25° C. to 450° C. for the abrasive tools herein is not greater than about 0.7%. It will be appreciated that the percent thermal expansion is a measure of linear thermal expansion of the abrasive tools as measured by taking a cross-sectional sample of the abrasive tool including all of its component abrasive portions and reinforcing members. In certain other embodiments, the percent thermal expansion is not greater than about 0.65%, such as not greater than about 0.6%, or even not greater than about 0.55%. Certain embodiments can have a percent thermal expansion that is within a range between about 0.3% and about 0.7%, such as between 0.3% and about 0.65%, or even more particularly between about 0.4% and about 0.65%.

Additionally, abrasive tools described herein have demonstrated improved grinding and cutting characteristics. For example, the abrasive articles of the embodiments herein demonstrated an improved G-ratio, which is a measure of the cubic volume of stock removal divided by the cubic volume of wear of the abrasive article, over conventional abrasive articles. Notably, for comparative purposes, the conventional abrasive articles included abrasives of the same design having the abrasive portion and reinforcing members. According to empirical evidence, the abrasive tools of the embodiments herein demonstrated a percent increase G-ratio of at least about 15% over conventional abrasive tools, wherein the percent increase is based on the equation $((G_N-G_C)/G_C)\times100\%)$, wherein $G_N$ represents the G-ratio of an abrasive tool having a particular porosity variation difference of not greater than 250% according to embodiments herein and $G_C$ represents the G-ratio of a conventional abrasive tool. In other embodiments, the percent increase of G-ratio is at least about 20%, such as at least about 25%, at least about 30%, at least about 35%, or even at least about 40%. Particular embodiments demonstrate a percent increase G-ratio within a range between about 15% and about 200%, such as within a range between about 15% and about 150%, and more particularly between about 15% and about 100%, and even more particularly between about 15% and about 75%.

EXAMPLES

Two types of abrasive articles were formed and tested to compare certain performance parameters; conventional samples (CS1) and novel samples according to embodiments herein (NS1). The CS1 samples are produced by forming an abrasive portion that includes mixing 65.31 wt % of abrasive grains of alumina and alumina-zirconia alloy grains with 34.7 wt % matrix material. The matrix material is formed of a mixture having approximately 57.3 vol % phenolic resin and a remainder amount comprising a mixture of pyrite fillers, aluminofluoride filler material, and moisture absorbing filler materials to aid the formation of the final-formed abrasive article. The mixture is then combined with layers of coated glass-fiber reinforcing members commercially available from IPAC within a forming chamber to form an abrasive preform. The abrasive preform is then pressed within the forming chamber at a pressure of 1.6 tons/in$^2$ at room temperature to form the final-formed abrasive article.

The NS1 samples are produced by forming an abrasive portion that includes mixing 62.2 wt % of abrasive grains of alumina with 31.5 wt % matrix material. The matrix material is formed of a mixture having approximately 72.8 vol % phenolic resin and a remainder amount comprising a mixture of pyrite fillers, aluminofluoride filler material, and moisture absorbing filler materials. The mixture is then combined with layers of coated glass-fiber reinforcing members commercially available from IPAC within a forming chamber to produce an abrasive preform. The abrasive preform is pressed within the forming chamber at a pressure of 0.64 tons/in$^2$ at room temperature to form the final-formed abrasive article.

FIG. 5 includes a plot comparing the porosity variation of the conventional tool sample (CS1), represented by plot 501, and the sample of the abrasive tool according to embodiments herein (NS1), represented by plot 503. The porosity variation for each of the samples is based on a mean porosity of the sample bodies measured by CT scan, wherein the mean porosity of the CS1 sample is 3.76 vol % of the total volume of the body, and the mean porosity of the NS1 sample is 10.43 vol % of the total volume of the body. The plots 501 and 503 were generated using x-ray imaging technology for non-destructive characterization of the samples via scanning technology that can segment the sample into discrete planes and analyze the contents (e.g., percent porosity) of the abrasive tool within the analyzing plane. Characterization was carried out on a Phoenix x-ray machine, model V Tome X S. During testing, the voltage was set between 120-180 kV, with a current between 60 to 120 mA, using a Voxel size of 17-50 microns, timing of 333-3333 milliseconds, taking from 600 to 2900 images and using a Cu/Sn filter of a thickness 0-1 mm.

Plot 501 of the CS1 sample clearly demonstrates a significant porosity variation that increases and decreases sharply based on the location within the abrasive body. Notably, the CS1 sample demonstrates a substantial porosity variation difference calculated by the difference between the point 511 representing the greatest positive porosity variation value from the mean porosity (approximately 350%), and the point 512 representing the greatest negative porosity variation value from the mean porosity (approximately −100%) for a total porosity variation difference of approximately 450%. By contrast, plot 503 of the NS1 sample demonstrates significantly less porosity variations through the thickness of the sample body. In particular, the porosity variation difference of the NS1 sample as measured between the point 523 having an approximate value of 120% as compared to the point 524 having an approximate value of −40%, is calculated to be approximately 160%. As illustrated, the NS1 samples have a significantly greater uniformity in the porosity distribution throughout the body as compared to conventional abrasives, which can result in improved performance.

The NS1 and CS1 samples are formed to have a 20 inch diameter (51 cm) and an average thickness of approximately 0.335 inches (0.85 cm). The CS1 and NS1 samples are then performance tested to compare their abrading efficiency by way of G-ratio. The G-ratio testing is conducted using a Braun cut-off saw, operating a 120 HP and 20,000 surface feet per minute of wheel speed. The workpiece is 1018 carbon steel of 1.5 inches bar stock fed at a rate of approximately 0.21 inches per second, and the testing is conducted by cutting one bar at a time for 200 cuts total. Three wheels are tested and evaluated for each of the samples types (CS1 and NS1).

Figure 6:
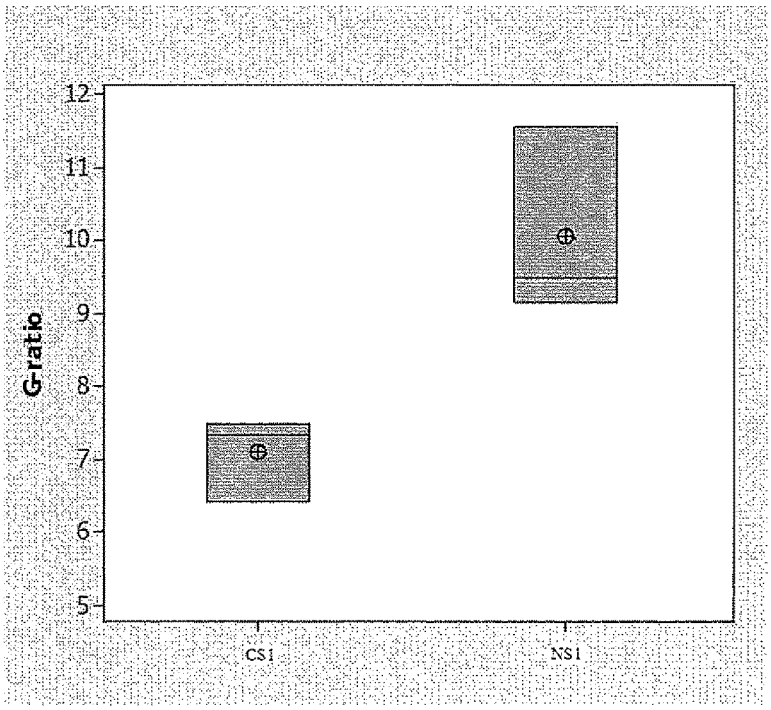
FIG. 6 includes a plot of G-ratio for a conventional abrasive tool and an abrasive tool of an embodiment.

FIG. 6 includes an illustration of a plot comparing the G-ratio of the CS1 and NS1 samples. As illustrated, the average G-ratio of the CS1 sample demonstrated a significantly lower G-ratio than the average G-ratio of the NS1 sample. In fact, the percentage increase in G-ratio based on the difference in the average G-ratio between the samples is approximately 30% greater for the NS1 sample over the CS1 sample. Accordingly, the samples formed according to embodiments herein demonstrated improved and more efficient abrasive capabilities over conventional abrasive articles.

The percent linear thermal expansion for the CS1 and NS1 samples were also tested as a way of measuring the expected thermal expansion during use of the article at high temperatures. Both samples were heated over a range of temperatures between 25° C. to 450° C. using an TMA-120 machine from Seiko Corporation. The samples were heated at a rate of 10° C./min.

Figure 7:
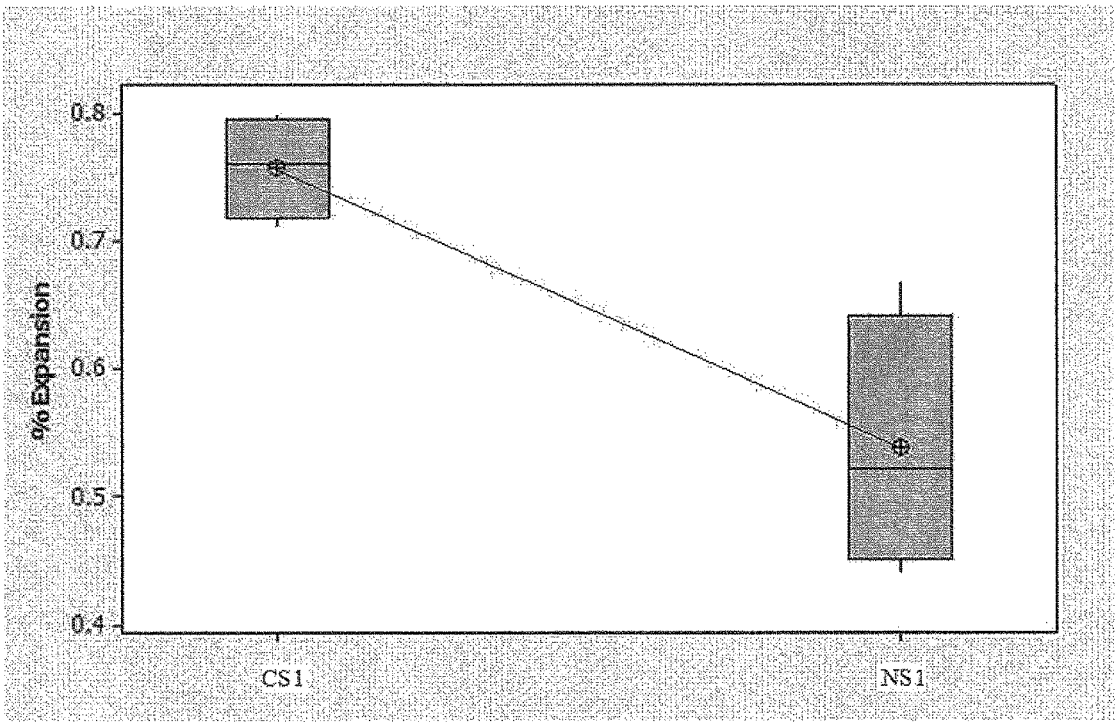
FIG. 7 includes a plot of linear thermal expansion for a conventional abrasive tool and an abrasive tool of an embodiment.

FIG. 7 includes an illustration of a plot comparing the linear percent thermal expansion for the CS1 and NS1 samples. As illustrated, the average percent thermal expansion for the CS1 samples were significantly higher than the percent linear thermal expansion of the NS1 samples. In fact, the CS1 samples demonstrated nearly a 30% increase in the average percent linear thermal expansion over the NS1 samples. Accordingly, the NS1 samples have a significantly lower thermal expansion, which makes them suitable for aggressive abrasive applications that generate significant temperatures and are more likely to avoid thermal-induced strains and failure during operations at high temperatures, particularly at interfaces between material components.

The processes and abrasive articles disclosed herein represent a departure from the state-of-the-art. Abrasive articles herein can utilize a combination of features including abrasive portions having certain abrasive portions utilizing abrasive grains and a matrix material for forming abrasive structures having particular aspect ratios of diameter and thickness. Furthermore, abrasive articles of the embodiments herein can have a significantly uniform porosity distribution throughout the body, and improved homogeneity of the porosity, which are thought to be responsible, at least in part, for improved performance characteristics. Additionally, the abrasive articles of the embodiments can utilize other features such as reinforcing members that can include various features.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. A large diameter abrasive wheel comprising:

a body having an aspect ratio defined as a ratio between diameter to thickness of at least about 10:1, wherein the body includes:

a first abrasive portion and a second abrasive portion distinct from the first abrasive portion, each of the first and second abrasive portions having abrasive grains contained within a matrix material comprising phenolic resin, wherein each of the first and second abrasive portions comprises at least about 40 vol % of abrasive grains, at least about 30 vol % matrix material and a mean porosity of at least about 5 vol % and not greater than about 30 vol %, wherein the mean porosity of each of the first and second abrasive portions is an average total porosity for a total volume of each of the first and second abrasive portions; and a first reinforcing member comprising glass-fiber and in the form of a layer distinct from the first and second abrasive portions and contained within the body, wherein the first reinforcing member includes a first planar face with a first major surface and a second planar face with a second major surface, the second major surface being parallel to and spaced apart from the first major surface, wherein the first abrasive portion overlies and is in direct contact with the first major surface of the first reinforcing member at a first interface extending through a diameter of the body, and wherein the second abrasive portion overlies and is in direct contact with the second major surface of the first reinforcing member at a second interface extending through a diameter of the body; and wherein the body comprises a porosity variation difference through at least half of a thickness of the body of not greater than 250% from a mean porosity of the body.

2. The abrasive wheel of claim 1, wherein the body comprises an average thickness of not greater than about 3 cm.

3. The abrasive wheel of claim 1, wherein the body comprises a tapered region extending circumferentially around a portion of a periphery of the body.

4. The abrasive wheel of claim 3, wherein the tapered region of the body comprises an average thickness that is greater than an average thickness of a flat region of the body.

5. The abrasive wheel of claim 1, wherein the first reinforcing member comprises an inorganic material.

6. The abrasive wheel of claim 5, wherein the first reinforcing member comprises glass fibers.

7. The abrasive wheel of claim 6, wherein the first reinforcing member comprises phenolic resin-coated glass fibers.

8. The abrasive wheel of claim 1, wherein the first reinforcing member extends through an entire diameter of the body.

9. The abrasive wheel of claim 1, wherein the body further comprises a second reinforcing member within the abrasive portion.

10. The abrasive wheel of claim 9, wherein the first reinforcing member and second reinforcing member are spaced apart from each other.

11. The abrasive wheel of claim 10, wherein at least a portion of the first or the second abrasive portion is disposed between the first reinforcing member and the second reinforcing member.

12. The abrasive wheel of claim 1, wherein the porosity variation difference is not greater than about 225% for at least half of the thickness of the body.

13. The abrasive wheel of claim 1, wherein the porosity variation difference is not greater than about 250% for an entire thickness of the body.

14. The abrasive wheel of claim 1, wherein the matrix material comprises at least about 65 vol % organic material.

* * * * *